US006039206A

United States Patent [19]

DeFrancesco

[11] Patent Number: 6,039,206

[45] Date of Patent: Mar. 21, 2000

[54] STABILE CUP AND MUG HOLDER

[75] Inventor: Stephen Michael DeFrancesco, New Haven, Conn.

[73] Assignee: Stephen M. DeFrancesco, New Haven, Conn.

[21] Appl. No.: 09/328,358

[22] Filed: Jun. 9, 1999

[51] Int. Cl.[7] ..... B65D 21/02

[52] U.S. Cl. ..... 220/737; 220/903; 220/23.89; 220/23.87; 248/311.2

[58] Field of Search ..... 220/903, 737, 220/739, 720, 23.83, 23.86, 23.89, 23.87, 630, 729; 248/311.2, 146, 346.11, 151, 149

[56] References Cited

U.S. PATENT DOCUMENTS 4,969,618 11/1990 Thompson ..... 248/152
5,398,898 3/1995 Bever ..... 248/154
5,687,874 11/1997 Omori et al. ..... 220/737
5,782,448 7/1998 Withun et al. ..... 248/311.2

*Primary Examiner*—Stephen Castellano

[57] ABSTRACT

A cup or a mug holder comprising of a body with cut out sides to accommodate mug handle, flexible bands to hold a cup or a mug, movable legs attached to the flexible bands, and the bottom lid. When a cup or a mug is placed in the holder, flexible bands push the legs outside extending horizontal surface of the holder creating a stabile platform. Flexible bands hold the mug and retract the legs when the mug is taken out of the holder. Bottom lid prevents accidental small quantities of liquid from seeping through the bottom of the holder.

2 Claims, 3 Drawing Sheets

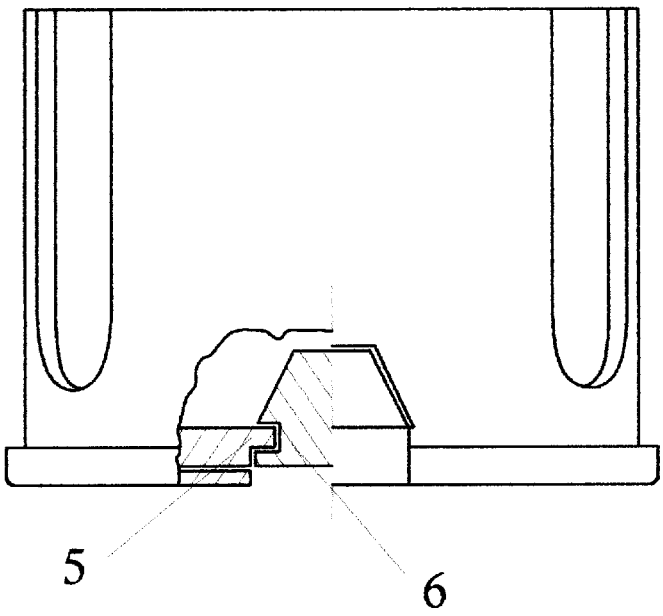
*Fig. 5*
*Fig. 6*
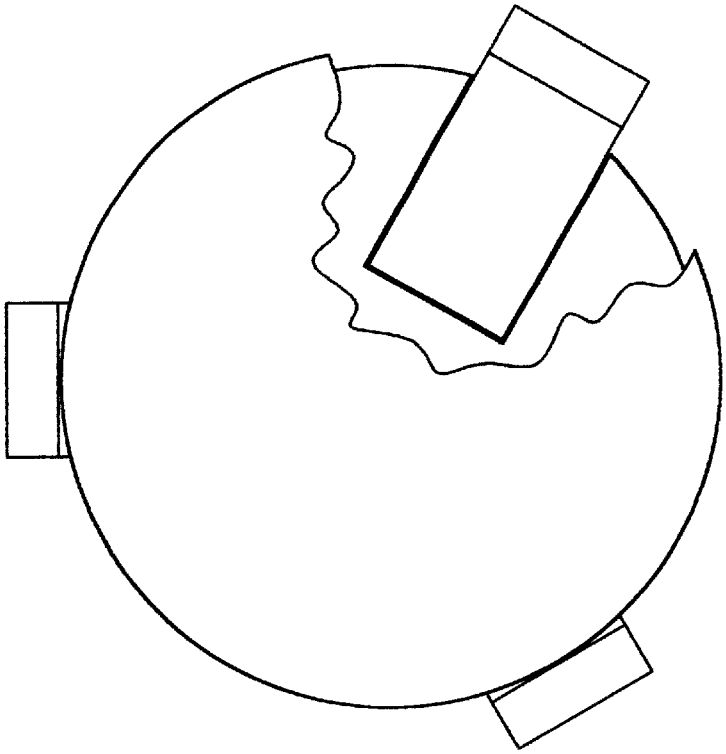

STABILE CUP AND MUG HOLDER

CROSS-REFERENCES TO RELATED APPLICATIONS

Not applicable.

STATEMENTS AS TO RIGHTS TO INVENTIONS MADE UNDER FEDERALLY SPONSORED RESEARCH AND DEVELOPMENT

Not applicable.

BACKGROUND OF THE INVENTION

The need for an item that will hold a cup or a mug more secured from tipping over while being set on the table has always been a need. As the current market clearly shows, there are numerous different approaches to solving this problem. Some inventions are based on heavy bottom holders thus increasing stability. Some inventions are based on various methods of grabbing a cup or a mug where bottom would be firmly secured to the surface of the table or a counter. In another case cup holders would have a lid to secure beverage from spilling. The Stabile Cup and Mug Holder is a new innovative approach to solving this problem.

OBJECT OF THE INVENTION

Object of my invention was to solve several problems regarding cup or mug holders. My first objective was to combine firm wall of the holder yet the possibility for a mug to be placed in as well as a cup. Second problem was to create a holder that will take less space possible when not in use. And third, a cup or a mug once placed in the holder needed to be firmly held.

BRIEF DESCRIPTION OF THE DRAWINGS

FIG. 5 is a side elevational view with a half-partial section of a leg and a bottom groove;

FIG. 6 is a plane view of the bottom with partial section of the bottom lid exposing the bottom of the body of the stabile mug holder;

DETAILED DESCRIPTION OF THE DRAWINGS

Figure 1:
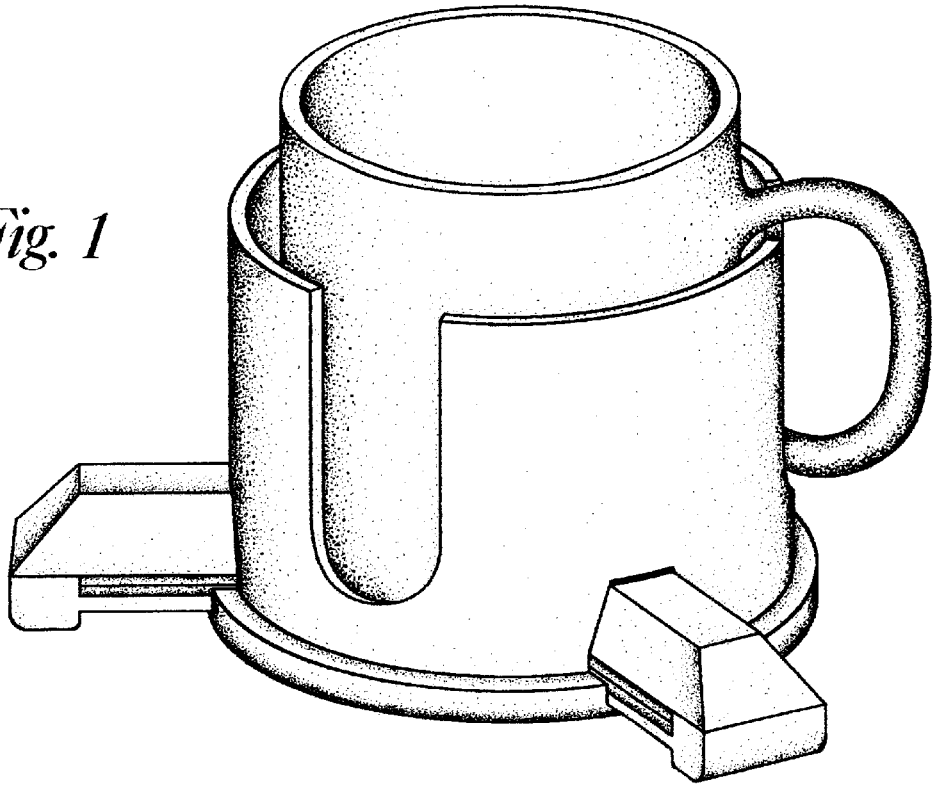
FIG. 1 is a pictorial view, in perspective, of the stabile mug holder presenting.
Figure 4:
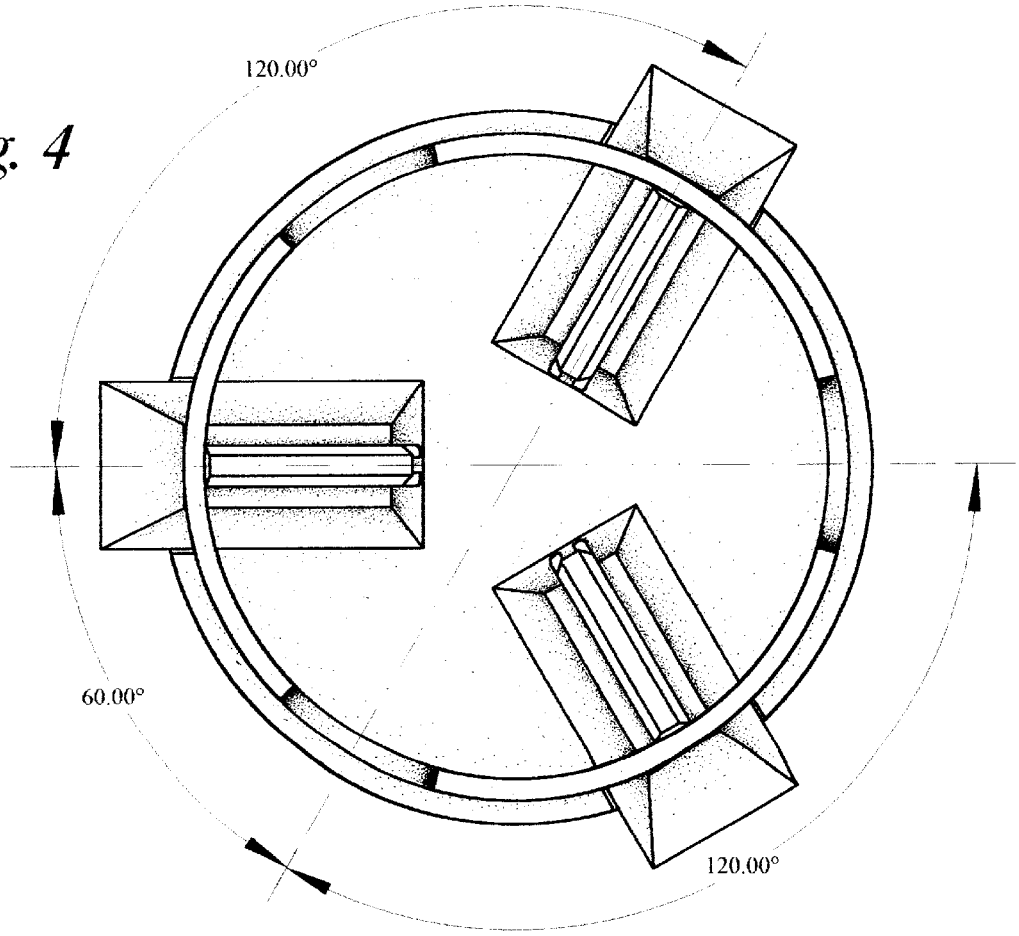
FIG. 4 is a top plane view thereof.

Stabile Cup and Mug Holder has been invented, as set forth in the objectives of the invention, to combine stability, versatility and adequate size. The holder is comprised of a cup shaped body 1, three legs 2, three flexible bands 3, and the bottom lid 4, as presented in FIG. 2. On the vertical round portion, body has three "U" shaped cutouts, as seen in FIG. 1, designed to accommodate mug handle. The cutouts are positioned at 120 degrees apart in reference to the round base of the body (FIG. 4). Body of the holder is also cut out to accommodate legs 2, partly on the vertical sides of the holder body (FIG. 5) and partly on the bottom of the body (FIG. 6). The bottom part is cut out in such a manner to create a groove 5 (FIG. 5) to match the groove on the legs 6 (FIG. 5). When in position, bottom of the legs are flash to the bottom of the holder body. The legs and the cut-outs are also positioned 120 degrees apart in reference to the round base of the body, but in reference to the "U" shaped cut-outs on the vertical sides of the body, it is positioned 60 degrees thereof (FIG. 4).

Figure 2:
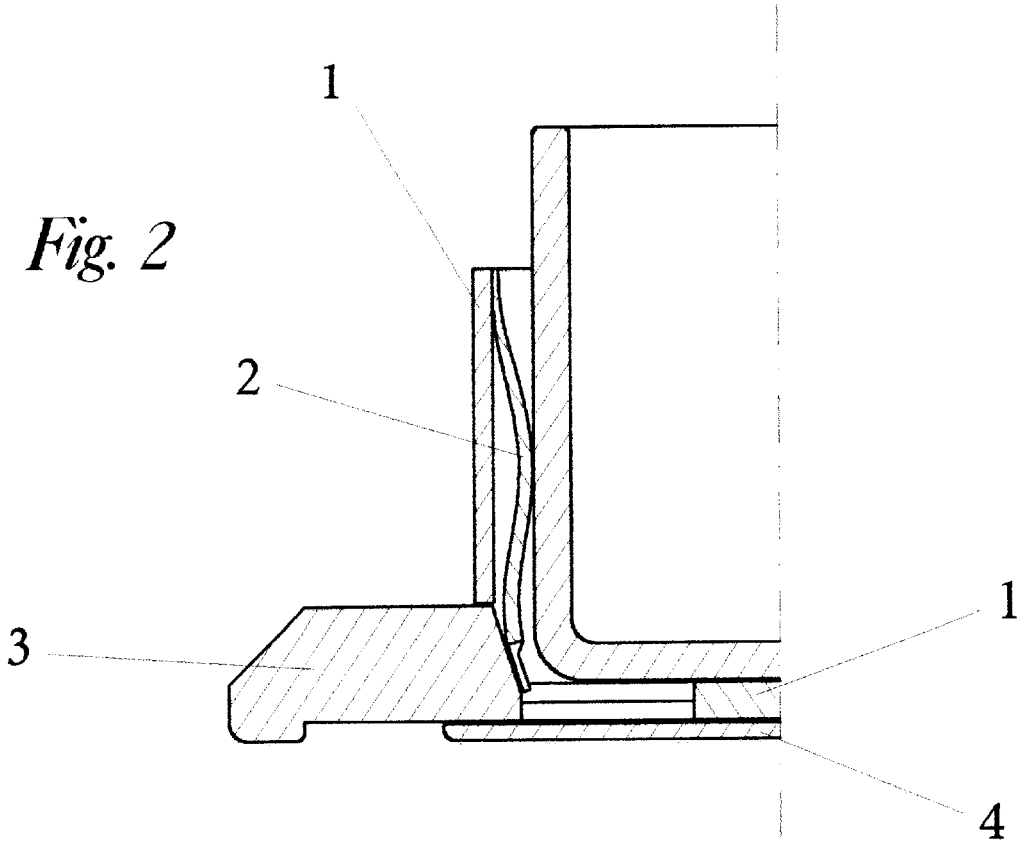
FIG. 2 is a side elevational half cross section view when a mug is in the holder.
Figure 3:
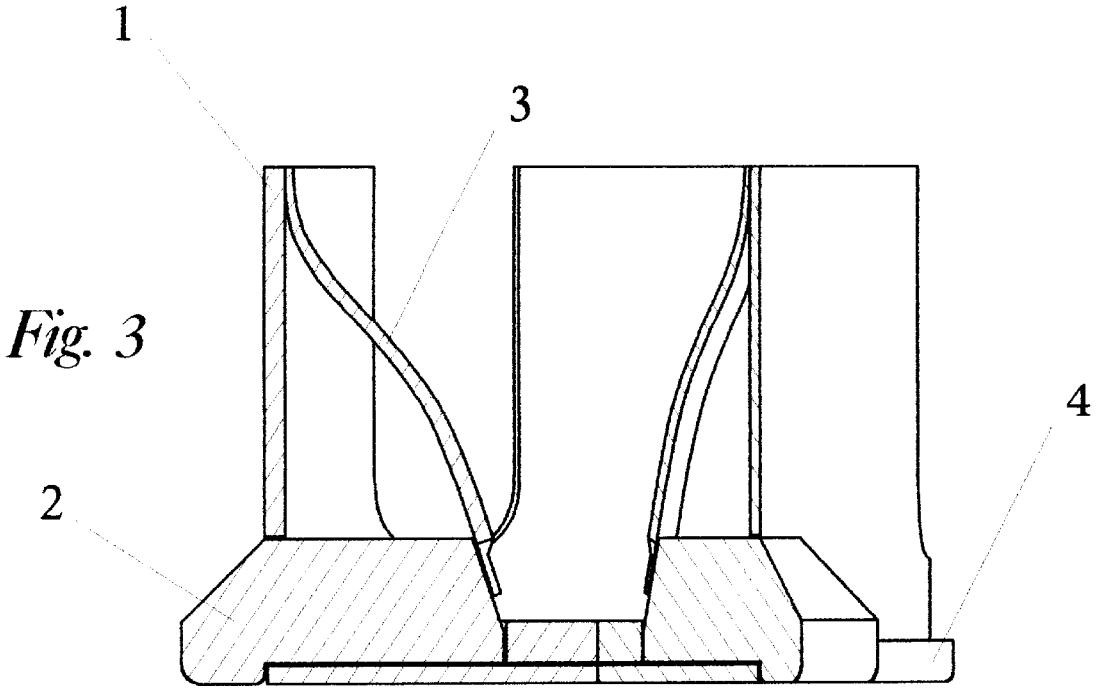
FIG. 3 is a side elevational one third cross section view of the holder without mug.

Flexible bands 3 are positioned vertically and attached on the top to the inside part of the top edge of the body (FIG. 3). At the bottom side, elastic bands are attached to the legs in such a manner that, when a mug is placed in the holder, pushing the bands and the legs towards outside, enough room is available to accommodate expansion (FIG. 2). The bottom lid 4 is round shaped and grooved on the edge to accommodate legs as seen in FIG. 1.

When not in use, legs are retracted towards inside by the tension of the bands (FIGS. 3 and 4), therefore reducing the space that the holder takes. Placing a mug or a cup in the holder results in flexible bands being pushed towards outside therefore pushing the legs as well (FIG. 2), thus increasing overall bottom surface of the holder and creating a stabile platform. However, when a mug or a cup is taken out of the holder the legs will retract. The tension of the bands should be sufficient enough to retract and hold the item securely, yet allowing easy release.

In the event when small quantities of liquid escape over the brim of a cup or a mug, since the bottom of the holder body is cut out to accommodate the legs, the lid will retain the liquid. The lid is also removable and the hole assemble is easy to clean and maintain.

I claim as my invention:

1. A beverage container holder comprising:

a body having a cylindrical sidewall and a bottom wall, said sidewall having a top edge and a plurality of circumferentially spaced openings adjacent to said bottom wall, a plurality of stabilization legs extend radially through said openings in said sidewall, said legs each having inner ends, said openings allowing for the sliding movement of said legs therethrough between an inwardly extending stored position and an outwardly extending protruding position, a plurality of flexible bands each having an upper end and a lower end, said lower ends of said flexible bands are attached to said stabilization legs at the inner ends thereof and said upper ends of said flexible bands are attached to said sidewall adjacent to said top edge, the bands are biased inwardly at their lower ends and the attached legs are also biased towards said inwardly stored position when the holder is empty, said bands are adapted to move outwardly upon the placement of a beverage container into said body through said top edge, the outer sides of the beverage container push outwardly against said lower ends of said flexible bands and the stabilization legs are moved outwardly to said protruding position.

2. The beverage container holder according to claim 1 further comprising a plurality of U-shaped slots extending from the top edge of said sidewall, said slots being circumferentially spaced approximately 60 degrees with respect to said circumferentially spaced openings.

* * * * *